United States Patent [19]

Kaneko et al.

[11] Patent Number: 4,698,981

[45] Date of Patent: Oct. 13, 1987

[54] AIR CONDITIONER HAVING A TEMPERATURE DEPENDENT CONTROL DEVICE

[75] Inventors: Tomomichi Kaneko; Shigeyasu Suzuki; Shouji Arakawa, all of Tochigi, Japan

[73] Assignee: Hitachi, Ltd., Tokyo, Japan

[21] Appl. No.: 907,094

[22] Filed: Sep. 15, 1986

[30] Foreign Application Priority Data

Sep. 20, 1985 [JP] Japan ..... 60-206461

[51] Int. Cl.[4] ..... F25D 17/00; F25B 41/04

[52] U.S. Cl. ..... 62/180; 62/186; 62/223; 62/225

[58] Field of Search ..... 62/186, 181, 183, 224, 62/225, 160, 212, 180, 177, DIG. 17, 223; 236/35, 38, DIG. 9

[56] References Cited

U.S. PATENT DOCUMENTS

| | | | |
|---|---|---|---|
| 3,389,576 | 6/1968 | Mauer | 62/DIG. 17 |
| 4,117,344 | 9/1978 | Boerstler et al. | 60/667 X |
| 4,375,753 | 3/1983 | Imasu et al. | 62/225 X |

*Primary Examiner*—Harry Tanner

*Attorney, Agent, or Firm*—Antonelli, Terry & Wands

[57] ABSTRACT

An air conditioner has a refrigeration system comprising by a compressor, a reversing valve, an indoor heat exchanger, an expansion device and an outdoor heat exchanger which are connected in series to form a closed system, a bypass pipe equiped with a two-way valve, connected in parallel with the outdoor heat exchanger between the delivery side of the compressor and the refrigerant inlet side of the outdoor heat exchanger. An outdoor blower is provided for the outdoor heat exchanger. The two-way valve is adapted to permit hot refrigerant gas delivered by the compressor to be recirculated through the outdoor heat exchanger thereby effecting defrosting of the outdoor heat exchanger. The air conditioner further has an expansion control means for controlling the extent of expansion of the refrigerant in accordance with the temperature of the refrigerant in the refrigeration system, and an outdoor blower speed control means for maintaining a constant speed of the outdoor blower when the outdoor air temperature is below a predetermined set temperature.

7 Claims, 8 Drawing Figures

AIR CONDITIONER HAVING A TEMPERATURE DEPENDENT CONTROL DEVICE

BACKGROUND OF THE INVENTION

1. Field of the Invention

The present invention relates to an air conditioner and, more particularly, to an air conditioner of heat-pump type.

2. Description of the Prior Art

A conventional air conditioner of heat-pump type encounters a problem that the operation is seriously impaired due to frosting on the outdoor heat exchanger, when the outdoor air temperature is low. In order to obviate this problem, it has been a common practice to employ a thermostatic expansion valve as the expansion device during the heating mode of operation of the air conditioner. A typical refrigeration system of a heat-pump type air conditioner employing such a thermostatic expansion valve will be explained hereinunder with reference to FIG. 5.

Referring to FIG. 5, the air conditioner has a compressor 1, a four-way type reversing valve 2, an indoor heat exchanger 6, a thermostatic expansion valve 7, and an outdoor heat exchanger 5 which are connected in such a manner as to form a refrigeration system. In the heating mode operation of the air conditioner, a refrigerant flows through this system as indicated by arrows. The amount of expansion performed by the thermostatic expansion valve, i.e., the amount of restriction of the refrigerant passage in the expansion valve, is controlled in accordance with the refrigerant temperature which is sensed by a sensing bulb 11 which is secured to the wall of the refrigerant pipe between the reversing valve 2 and the input side of the compressor 1. The arrangement is such that, when frost is generated on the outdoor heat exchanger 5 during operation at low ambient air temperature, the temperature of the refrigerant into the compressor 1 is lowered correspondingly and the sensing bulb 11 which detects this temperature drop operates to restrict the area of the refrigerant passage in the expansion valve 7, in accordance with the superheating characteristics of the expansion valve 7. A capillary tube 22 connected in parallel with the expansion valve 7 has a function to reduce the extent of restriction in the expansion valve 7, thus enabling delicate control of the degree of superheating of the refrigerant, during operation of the air conditioner in the cooling mode. The capillary tube 22 also serves as a balancing capillary for maintaining system balance which may otherwise be lost due to closing of the expansion valve 7 during operation in the cooling mode or during suspension of heating mode operation, when the ambient air temperature is not so high.

A bypass pipe 3 having a two-way valve 4 is connected between the input side of the compressor 1 and the output side of the outdoor heat exchanger 5.

The thermostatic expansion valve has a superheating characteristics as shown in FIG. 6. It will be seen that the superheating degree $\Delta t_1$ obtained when the temperature sensed by the sensing bulb is comparatively low as represented by $T_1$ is smaller than the superheating degree $\Delta t_2$ obtained when the temperature sensed by the sensing bulb is comparatively high as represented by $T_2$. The superheating degree, therefore, has to be determined such that the compressor motor winding temperature does not exceed an allowable temperature even in overloaded operation in the heating mode. This inevitably requires that the superheating degree is set at a comparatively low level. FIG. 6 is a diagram showing saturation curve which represents the relation between pressure and temperature of a refrigerant. More specifically, axis of ordinate represents the pressure, while the axis of abscissa represents the temperature. A solid-line curve (1) shows the saturation cuve of a refrigerant such as $R_{22}$, while a solid-line curve (2) represents the change in the temperature of the refrigerant, i.e., change in superheating degree, across the thermostatic expansion valve 7.

When the air conditioner having a refrigeration system with such a small degree of superheating in the expansion valve operates in the heating mode at a comparatively low ambient air temperature, a phenomenon known as "liquid back" tends to occur with the result that the temperature of the compressor is lowered abnormally. On the other hand, the frost on the outdoor heat exchanger grows so that the air-flow resistance across the outdoor heat exchanger is progressively increased as shown by curves a, b and c in FIG. 7A. This in turn causes a reduction in the speed of the fan of the blower provided on the outdoor heat exchanger, as shown in FIG. 7B, causing a further reduction in the air flow rate through the outdoor heat exchanger. This inconveniently lowers the evaporation temperature in the outdoor heat exchanger so as to promote the frosting and to further lower the temperature of the compressor. FIGS. 7A and 7B show air flow rate characteristics of the blower on the outdoor heat exchanger. In FIG. 7A, the axis of ordinate represents the difference in head or pressure between the suction side and the discharge side of the blower, while the axis of abscissa represents the air flow rate. In FIG. 7B, the axis of ordinate and the axis of abscissa represent, respectively, the speed of the fan of the blower and the air flow rate.

The air conditioners of the kind described above usually employ a defrosting system which relies upon recirculation of the hot refrigerant from the compressor through the outdoor heat exchanger. In such a defrosting system, the defrosting heat quantity is given as the sum of the heat accumulated in the compressor and the compressor power requirement. Thus, the quantity of heat accumulated in the compressor shares a significant portion of the defrosting heat quantity. In case of a heavy frosting on the outdoor heat exchanger, however, the heat accumulated in the compressor is soon consumed away so that an impractically long defrosting time is required for melting the heavy frost. Needless to say, the heavy frosting causes a serious reduction in the heating power of the air conditioner, before the defrosting is commenced.

Thus, the conventional air conditioners have suffered a problem in that the mean heating capacity tends to be reduced when the ambient air temperature is low, thus failing to meet the demand for comfort. Air conditioners of the type described are shown, for example, in Japanese Utility Model Laid-Open Nos. 61873/1981 and 67969/1981.

SUMMARY OF THE INVENTION

Accordingly, it is an object of the invention to provide a heat-pump type air conditioner which is improved so as to suppress the liquid back to the compressor and frosting on the outdoor heat exchanger, during operation in the heating mode while the ambient air temperature is low.

To this end, according to the invention, there is provided an air conditioner of heat-pump type, having an electrically controlled expansion valve which is adapted to be controlled so as to avoid liquid back to the compressor, and a control means for controlling the speed of the outdoor blower in such a manner as to raise the evaporation temperature in the outdoor heat exchanger when the air conditioner operates in the heating mode at low ambient air temperature. With this arrangement, it is possible to increase the quantity of heat accumulated in the compressor before the defrosting cycle is started and to reduce the frosting tendency on the outdoor heat exchanger.

DESCRIPTION OF THE PREFERRED EMBODIMENTS

A preferred embodiment of the invention will be described hereunder with reference to FIGS. 1 and 2.

Figure 1:
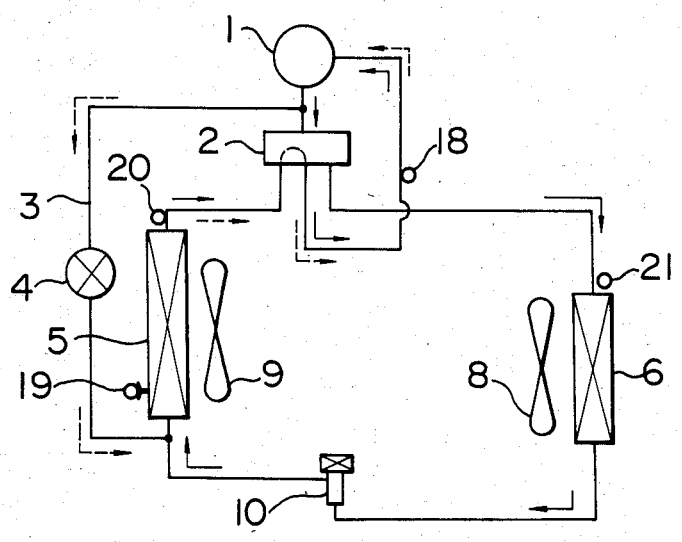
FIG. 1 is a diagram showing the refrigeration cycle of an air conditioner embodying the present invention.
Figure 2:
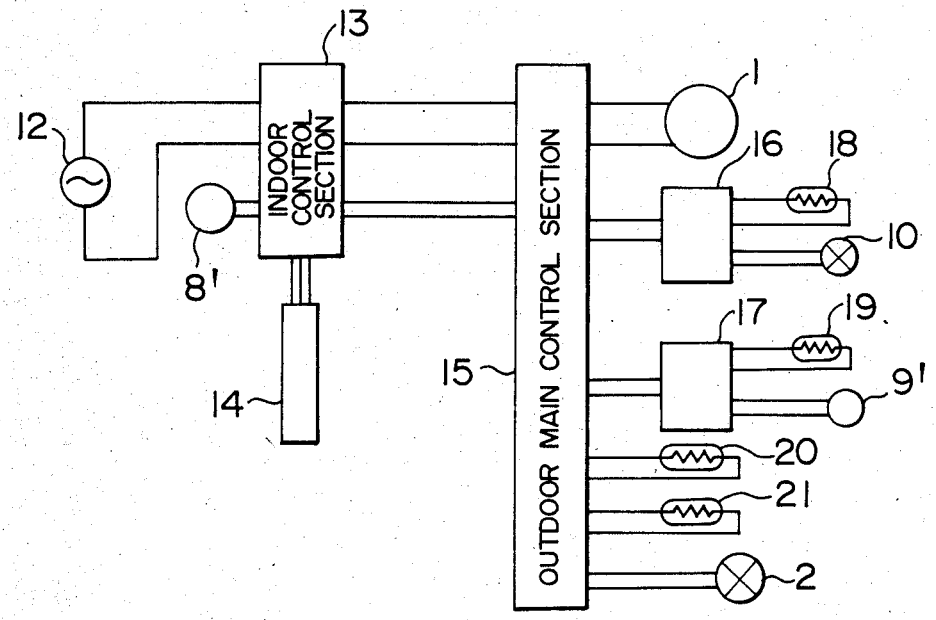
FIG. 2 is a schematic diagram of a control section incorporated in the air conditioner of the invention.

As shown in FIG. 1, the air conditioner embodying the present invention has a refrigeration cycle which is constituted by a compressor 1, a reversing valve 2, an outdoor heat exchanger 5, a controllable expansion device 10, and an indoor heat exchanger 6 which are connected in the mentioned order so as to form a refrigeration cycle. A bypass pipe 3 having a two-way valve 4 is connected between the output side of the compressor 1 and the end of the outdoor heat exchanger 5 adjacent the expansion device 10. During normal operation of the heat exchanger in the heating mode, the refrigerant flows as indicated by solid-line arrows in FIG. 1. However, in the defrosting period, the two-way valve 4 is opened so that the hot refrigerant gas delivered by the compressor is directly introduced into the outdoor heat exchanger 5, so that the frost on the heat exchanger 5 is melted by the heat posessed by the hot refrigerant gas. A temperature sensor 18 is provided on the input side of the compressor 1 so as to sense the temperature of the refrigerant gas which is being input to the compressor 1. On the other hand, an ambient air temperature sensor 19 for sensing the outdoor ambient air temperature is disposed on the air inlet side or its vicinity of the outdoor heat exchanger 5. A temperature sensor 20 disposed in the vicinity of the refrigerant outlet side of the outdoor heat exchanger 5 is adapted to detect the commencement and finish of the defrosting operation. A temperature sensor 21 similar to the sensor 20 is provided on the indoor heat exchanger 6. This temperature sensor 21 is adapted to sense the temperature in the indoor heat exchanger 6 during the period of pre-heating operation such as that conducted after the defrosting, so as to control the indoor air flow rate according to the sensed temperature, thereby preventing excessive drop of the outlet air temperature.

In the described embodiment, the controllable expansion device 10 is constituted by an electrically controlled expansion valve which is actuated by an electric stepping motor. Referring now to FIG. 2 which illustrates a control system for the air conditioner having the refrigeration cycle as shown in FIG. 1, the control system has an indoor control section 13 and an outdoor control section 15. A single-phase A.C. power supply 12 is connected to the indoor control section 13 and further to the outdoor control section 15.

Instructions such as mode selection instruction are given from a control panel 14 to the indoor control section 13 through signal lines. On the other hand, the outdoor control section 15 is adapted to perform the control of operation of the compressor 1, as well as the control of the reversing valve 2. The outdoor control section 15 further has an expansion valve control section 16 for controlling the expansion valve 10 and an outdoor blower control section 17 for controlling the outdoor blower 9. In addition, the temperature sensor 20 on the refrigerant outlet side of the outdoor heat exchanger 5 and the temperature sensor 2 on the indoor heat exchanger 6 are connected to the outdoor control section 15. The expansion valve 10 and the temperature sensor 18 are connected to the expansion valve control section 16, while the ambient air temperature sensor 19 and an electric motor 9' for driving the outdoor blower 9 are connected to the outdoor blower control section 17.

As the user gives an instruction through the control panel 14 for operating the air conditioner in the heating mode, the motors for driving the compressor 1 and the indoor blower 8, as well as the motor 9' for the outdoor blower 9, are started. In addition, the expansion valve control section 16 controls the degree of opening of the expansion valve 10 in such a manner that the difference (Ts−Tc) is maintained between the refrigerant temperature Ts at the input side of the compressor sensed by the temperature sensor 18 and the refrigerant saturation temperature Tc sensed by the temperature sensor 20. In case of overloaded operation, when the input temperature Ts has become abnormally high, the expansion valve 10 is controlled in such a manner as to reduce the temperature differences (Ts−Tc). Conversely, when the air conditioner operates while the ambient temperature is low, the expansion valve 10 is controlled such that a large temperature difference (Ts−Tc) is obtained.

Figure 3:
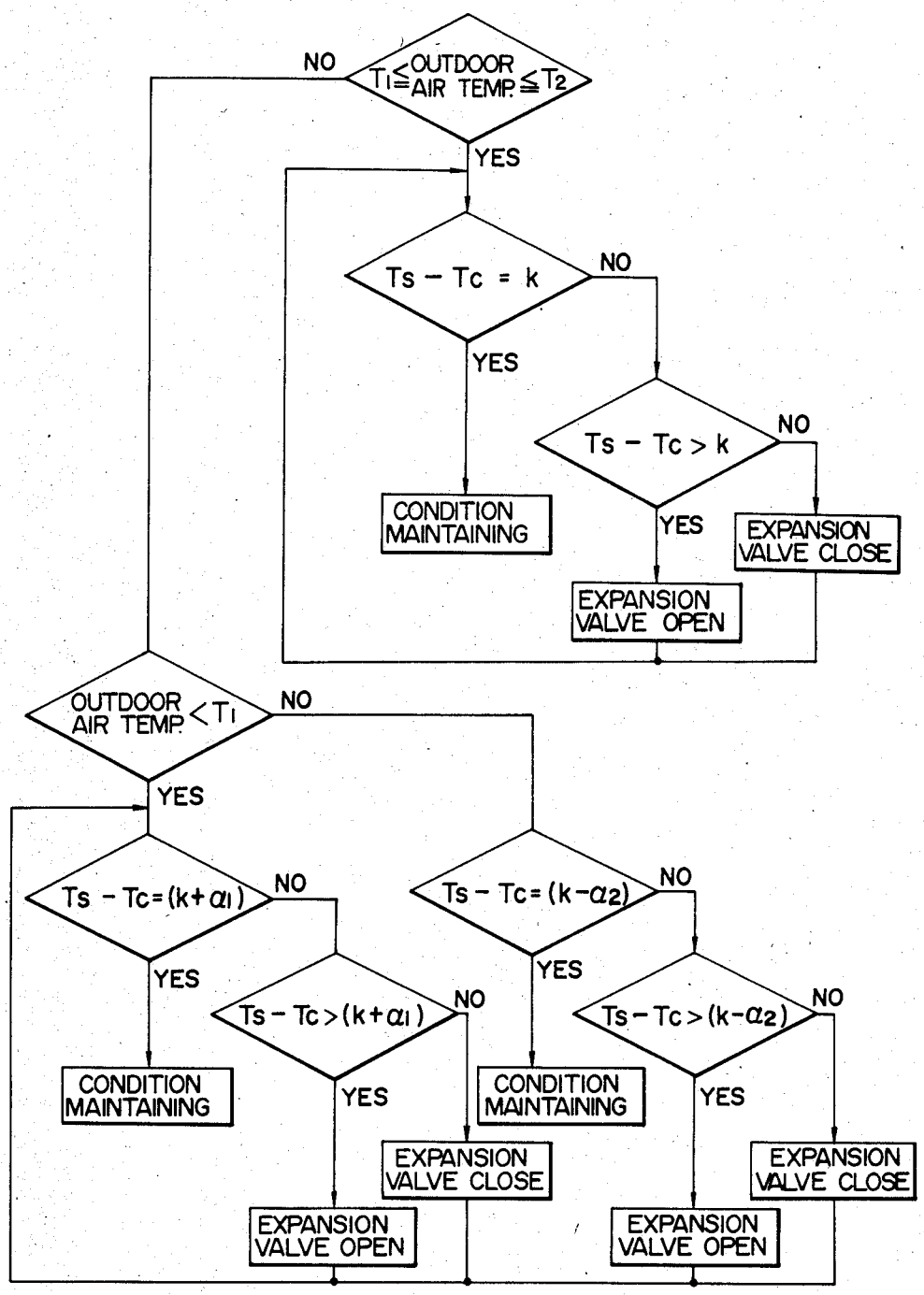
FIG. 3 is a flow chart showing the process for the control of an electrically controlled expansion valve.

The process for controlling the electrically controlled expansion valve 10 will be explained hereinunder with reference to FIG. 3 which shows the flow of the control process. When the ambient air temperature sensed by the outdoor air temperature sensor 19 ranges between a lower set value $T_1$ and a higher set value $T_2$, a judgement is conducted as to whether the temperature difference (Ts−TC), i.e., the degree of superheating, is maintained at the set value k. If the answer is YES, the instant operating condition is maintained. However, if the answer is NO, a judgement is conducted as to whether the detected temperature difference (Ts−Tc) is greater than the set value k of the superheating degree. If the detected temperature difference is greater than the set value k, the expansion valve 10 is controlled such so as to increase the opening degree thereof, whereas, if the sensed temperature difference is smaller than the set value k, the expansion valve 10 is controlled so as to restrict the passage of the refrigerant. If the sensed outdoor ambient air tempeature does not range between the set temperatures $T_1$ and $T_2$, a judgement is conducted as to whether the detected air temperature is below the lower set temperature $T_1$. It will be understood that an answer NO to this question means that the detected air temperature is above the higher set temperature $T_2$. Then, the superheating degree is set at different levels depending on whether the answer to this question is YES or NO, and the expansion valve 10 is controlled in accordance with the result of a comparison between the sensed temperature difference $(Ts-Tc)$ and respective set values $(k+\alpha_1)$ and $(k-\alpha_2)$. In this case, the temperatures Ts and Tc are sensed periodically.

More specifically, the set value $(k+\alpha_1)$ of the superheating degree is adopted when the sensed outdoor ambient air temperature is below the set temperature $T_1$, while the set value $(k-\alpha_2)$ is adopted when the same is above the higher set temperature $T_2$, where k represents the set value of the superheating degree adopted when the outdoor ambient air temperature falls within the range between the lower and higher set temperatures $T_1$ and $T_2$, while $\alpha_1$ and $\alpha_2$ represent constants.

Thus, the set values of the superheating degree are selected to meet the condition of $(k-\alpha_2)<(k+\alpha_1)$. Thus, the set value of the superheating degree is varied according to the outdoor ambient air temperature, and the expansion valve is controlled so as to provide the thus selected set value of the superheating degree, whereby the temperature of the compressor is maintained at a substantially constant level.

It will be understood that, during the operation of the air conditioner in the heating mode, the temperature of the refrigerant gas output by the compressor and the temperature of the compressor itself are maintained at substantially constant high levels, even when the compressor is overloaded and even when the outdoor ambient air temperature is low. Practically, the temperature of the compressor is maintained around 95° C. or so, taking into account the reliability of the compressor.

When the outdoor ambient air temperature is below the lower set temperature during operation in the heating mode, frosting on the outdoor heat exchanger 5 begins so that the speed of the motor 9' for driving the fan of the outdoor blower 9 is gradually lowered due to increase in the air flow resistance through the outdoor heat exchanger 5. The reduction in the outdoor ambient air temperature is detected by the temperature sensor 19. In the described embodiment, the reduction in the speed of the motor 9' is sensed by the outdoor blower control section 17 which detects reverse electromotive force generated by the fan motor 9' which is a three phase D.C. motor, and the outdoor blower control section 17 operates to maintain a constant speed of the outdoor blower 9.

Figure 4:
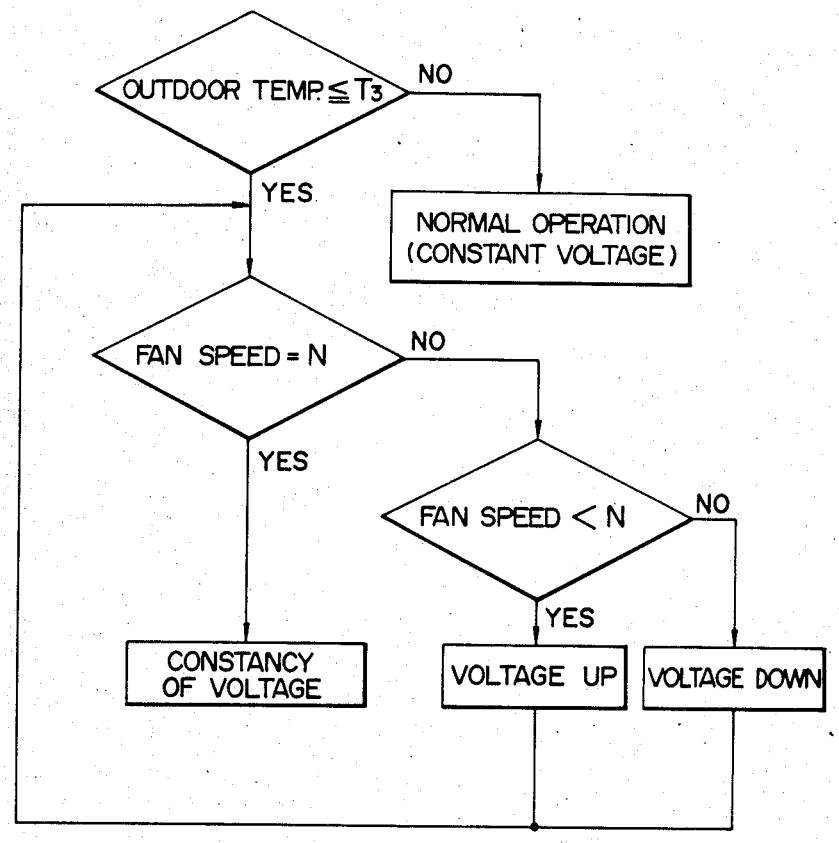
FIG. 4 is a flow chart showing the process for controlling an outdoor blower in the air conditioner of the invention.
Figure 5:
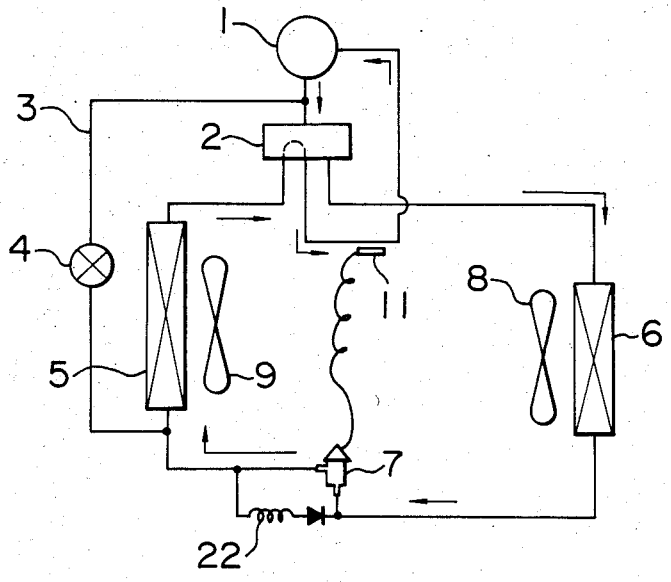
FIG. 5 PRIOR ART
FIG. 5 is a schematic diagram showing the construction of a conventional air conditioner emloying a hot-gas bypass type defrosting system.
Figure 6:
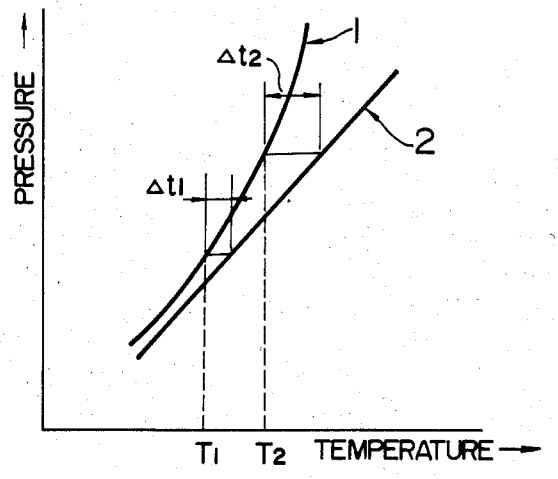
FIG. 6 is a chart showing the operation charcteristics of a thermostatic expansion valve incorporated in the conventional air conditioner.
Figures 7A, 7B:
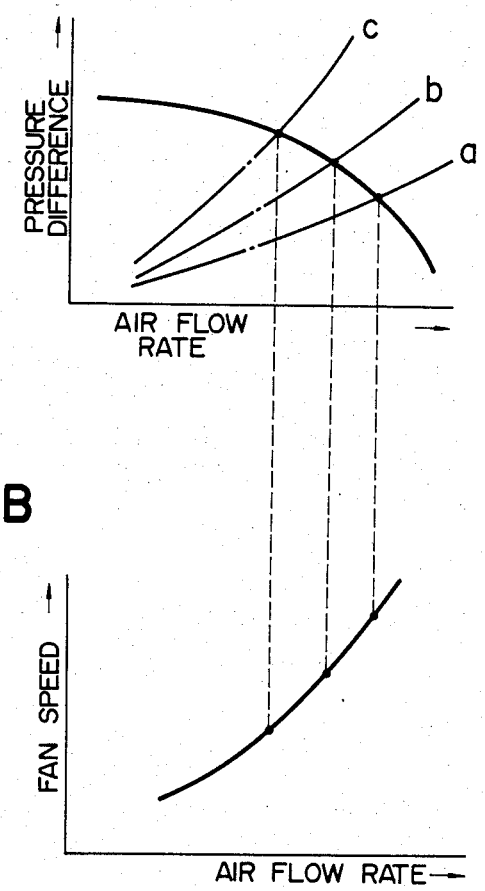
FIGS. 7A and 7B are charts showing air flow-rate characteristics of an outdoor blower incorporated in the conventional air conditioner.

The operation of the outdoor blower control section 17 will be explained hereinunder with reference to a flow chart shown in FIG. 4.

As the first step, a judgement is conducted as to whether the detected outdoor ambient air temperature is below a set temperature $T_3$. If the answer is NO, the motor 9' is operated steadily at a constant voltage. If the answer is YES, i.e., if the outdoor ambient air temperature has come down below the set temperature $T_3$, a judgement is conducted as to whether the fan of the blower is operating at a set speed N (r.p.m.). If the answer is YES, the D.C. voltage applied to the motor 9' is kept unchanged, whereas, if the answer is NO, a judgement is conducted as to whether the instant fan speed is below the set speed N. If the answer is YES, i.e., if the instant fan speed is below the set speed N, the D.C. voltage applied to the motor 9' is raised, whereas, if the answer is NO, i.e., if the instant fan speed is higher than the set speed N, the D.C. voltage is lowered. Thus, the fan speed is maintained at the set speed N, through repetitional detection of the fan speed.

Practically, the opening degree of the expansion valve and the capacity of the same are selected such that no frosting on the outdoor heat exchanger occurs even when the outdoor ambient air temperature has come down to 7° C. The set temperature $T_3$, therefore, is preferably selected to be about 5° to 6° C.

The described control of the outdoor blower makes it possible to suppress any drastic reduction of the evaporation temperature in the outdoor heat exchanger, without being accompanied by a rise in the noise level. It is thus possible to remarkably suppress the frosting tendency on the outdoor heat exchanger. At the same time, the reduction in the temperature of the refrigerant input to the compressor is suppressed, so that the compressor temperature can be maintained at a high level without substantial difficulty.

As has been described, according to the invention, it is possible to maintain the compressor temperature at a high level in the state before the commencement of defrosting operation and also to reduce the amount of frost on the outdoor heat exchanger, during the operation of the air conditioner in the heating mode while the outdoor ambient air temperature is low. This in turn enables a remarkable shortening of the defrosting time required for the defrosting by recirculation of the hot refrigerant through the outdoor heat exchanger and the compressor.

Obviously, the reduction in the amount of frost on the outdoor heat exchanger during the heating mode operation of the air conditioner suppresses any tendency of reduction in the heating power of the air conditioner. Thus, the invention provides a synthetic effect of an improvement in the mean heating capacity of the air conditioner during operation in the heating mode while the outdoor ambient temperature is low. Furthermore, a higher degree of comfort is ensured by virtue of shortening of the defrosting time. In addition, the use of an electrically controlled expansion valve as the expansion device eliminates the necessity for a specific expansion device which heretofore has been necessary for the operation in the cooling mode, as well as the necessity for the balancing capillary tube which has been also required for the purpose of maintaining the cycle balance during suspension of operation of the air conditioner. This is in turn simplifies the construction of the refrigeration cycle and lowers the production cost of the air conditioner as a whole.

What is claimed is:

1. An air conditioner system comprising:

a compressor, a reversing valve, an indoor heat exchanger, an expansion device comprising an electrically controlled expansion valve and an outdoor heat exchanger including an outdoor blower connected to form a closed system, a bypass pipe connected between an output side of said compressor and an input side of said outdoor heat exchanger, said bypass pipe including a two-way valve adapted to permit a hot refrigerant delivered by said compressor to be recirculated through said outdoor heat exchanger thereby effecting defrosting of said outdoor heat exchanger, first temperature sensing means for sensing the temperature of said refrigerant in the vicinity of an output of said outdoor heat exchanger and the temperature of said refrigerant at an input side of said compressor, second temperature sensing means for sensing the outdoor ambient air temperature, first control means for controlling a degree of opening of said expansion valve in accordance with the output from said first temperature sensing means and the outdoor ambient air temperature, and second control means for maintaining a constant speed of said outdoor blower in response to the output from said second temperature sensing means.

2. An air conditioner system according to claim 1, further comprising a third sensing means disposed in the vicinity of the output side of said outdoor heat exchanger for detecting initiation and completion of a defrosting operation for said outdoor heat exchanger.

3. An air conditioner system according to claim 1, wherein said first temperature sensing means comprises a first temperature detector for detecting the temperature of said refrigerant in the vicinity of the output side of said outdoor heat exchanger and a second temperature detector for detecting the temperature of said refrigerant at the input side of said compressor.

4. An air conditioner system according to claim 3, wherein said first control means controls the degree of opening of said expansion valve based on the difference between the temperatures of said refrigerant detected by said first and second temperature detectors and the outdoor ambient air temperature sensed by said second temperature sensing means such that when said ambient air temperature is within a first predetermined range, and the difference between the temperature detected by said first and second detectors corresponds to a first predetermined value, the temperature of said compressor is maintained at a substantially constant level.

5. An air conditioner system according to claim 1, wherein said outdoor blower includes a motor and a fan.

6. An air conditioner system according to claim 5, wherein said second control means includes means for sensing the rotational speed of said fan of said outdoor blower and means for controlling the speed of said fan based on said sensed rotational speed.

7. An air conditioner system according to claim 6, wherein said second cotrol means controls said outdoor blower such that when the outdoor ambient air temperature sensed by said second temperature sensing means is below a first predetermined range, and said rotational speed of said fan is below a second predetermined range, the speed of said fan is increased to be within said second predetermined range.

* * * * *